United States Patent [19]

Barbelet

[11] Patent Number: 4,929,026

[45] Date of Patent: May 29, 1990

[54] SEATING STRUCTURE WITH DISPLACEABLE WATER BLADDER

[76] Inventor: Barry D. Barbelet, 405 6th St., Pinetops, N.C. 27864

[21] Appl. No.: 324,010

[22] Filed: Mar. 15, 1989

[51] Int. Cl.[5] ..... A41C 3/00

[52] U.S. Cl. ..... 257/454; 297/452; 297/DIG. 3

[58] Field of Search ..... 297/454, 457, 284, 452, 297/180, DIG. 3

[56] References Cited

U.S. PATENT DOCUMENTS

| | | | |
|---|---|---|---|
| 3,999,801 | 12/1976 | Walters | 297/454 X |
| 4,189,181 | 2/1980 | Noble | 297/DIG. 3 |
| 4,391,466 | 7/1983 | Smith | 297/452 |
| 4,724,558 | 2/1988 | Reiff | 297/DIG. 5 |
| 4,726,624 | 2/1988 | Jay | 297/452 X |
| 4,738,486 | 4/1988 | Surber | 297/284 |

*Primary Examiner*—Peter A. Aschenbrenner
*Attorney, Agent, or Firm*—Rhodes, Coats & Bennett

[57] ABSTRACT

The present invention entails a seat structure including a water bladder that serves to support an individual disposed on the seat structure. In particular, the seat structure is contoured so as to form a well cavity intermediately between a leg support area and an inclined back. Formed in the well cavity is a displaceable water well. When an occupant sits on the water well the water therein is displaced upwardly along the inclined back and provides a padding and support structure about the back of the individual occupying the seat.

6 Claims, 3 Drawing Sheets

SEATING STRUCTURE WITH DISPLACEABLE WATER BLADDER

FIELD OF THE INVENTION

The present invention relates to seat structures such as lounge chairs, recliners, etc., and more particularly to a seat structure of this type having a water bladder.

BACKGROUND OF THE INVENTION

It is well appreciated that waterbeds have enjoyed tremendous success over the past years. In part at least, the reason for such success is the fact that waterbeds provide a very comfortable and flexible bed support structure. Although a waterbed is flexible and can generally conform to a person's body shape it is still sufficiently firm to provide an orthopedically suitable bedding support.

There have also been attempts at incorporating water bladders into sofas and other seat structures but the success and acceptance of water sofas and seat structures has not paralleled that of waterbeds. Frankly, designing a water containing seat structure in the form of a lounge chair is more difficult than designing a waterbed. This is because the shape of the seat structure is not totally level but is irregular and includes an upwardly extending back.

SUMMARY AND OBJECTS OF THE INVENTION

The present invention entails a seat structure that includes a body supporting water bladder. In particular, the seat structure and water bladder is designed so as to define a water well cavity intermediately of the seat structure. In a no-load situation there is an accumulation of water about an intermediate portion of the seat structure and that accumulation of water is referred to as a water well. Once the seat structure is occupied by a person, the weight of that person directed against the water well displaces water from the water well and drives the water up into the formally empty bladder portion disposed adjacent the inclined back of the seat structure. The displaced water from the water well that is now disposed adjacent the inclined back form a cushion or interface between the subject occupying the chair and the inclined or vertical back of the chair structure.

It is therefore an object of the present invention to provide a chair structure with a body supporting water bladder.

A more particular object of the present invention is to provide a water chair or recliner with a water bladder that in a no-load condition forms a relatively deep water well intermediately between the extreme end positions of the chair or recliner.

Still a further object of the present invention resides in the provision of a chair, recliner, sofa or the like that is designed to displace a volume of water into a bladder portion lying adjacent the back of the chair in response to a person placing his or her weight on the chair.

Another further object of the present invention resides in the provision of a water chair that is stable in both the load and no-load positions.

Still a further object of the present invention resides in the provision of a water seat structure that is relatively simple in design and which can be manufactured relatively inexpensively.

Still a further object of the present invention resides in the provision of a water type seat structure having a design that lends itself to a wide range of seating structure including recliners, lounge chairs, sofas, etc.

Other objects and advantages of the present invention will become apparent and obvious from a study of the following description and the accompanying drawings which are merely illustrative of such invention.

DETAILED DESCRIPTION OF THE INVENTION

Figure 1:
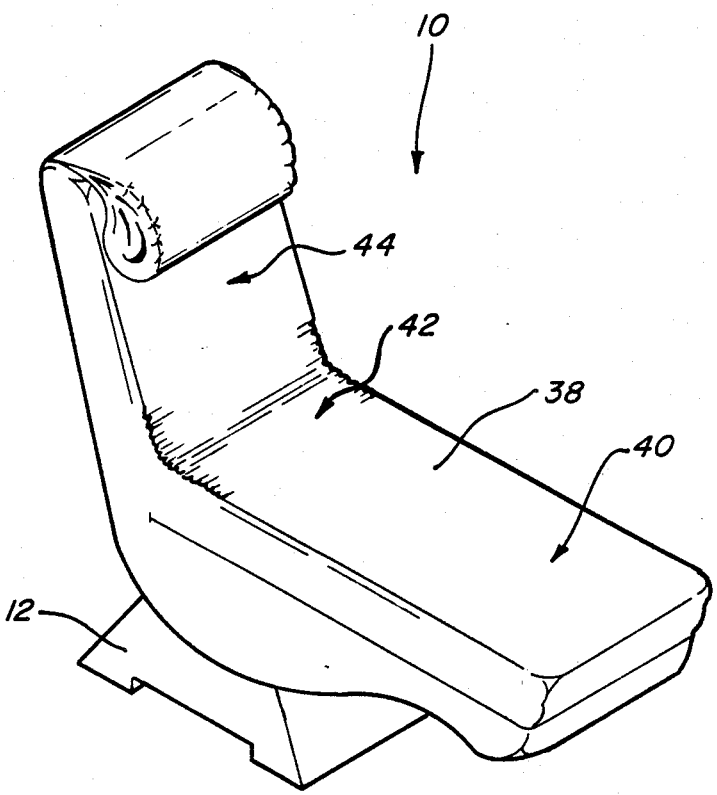
FIG. 1 is a perspective view of the water type seat structure of the present invention.
Figure 2:
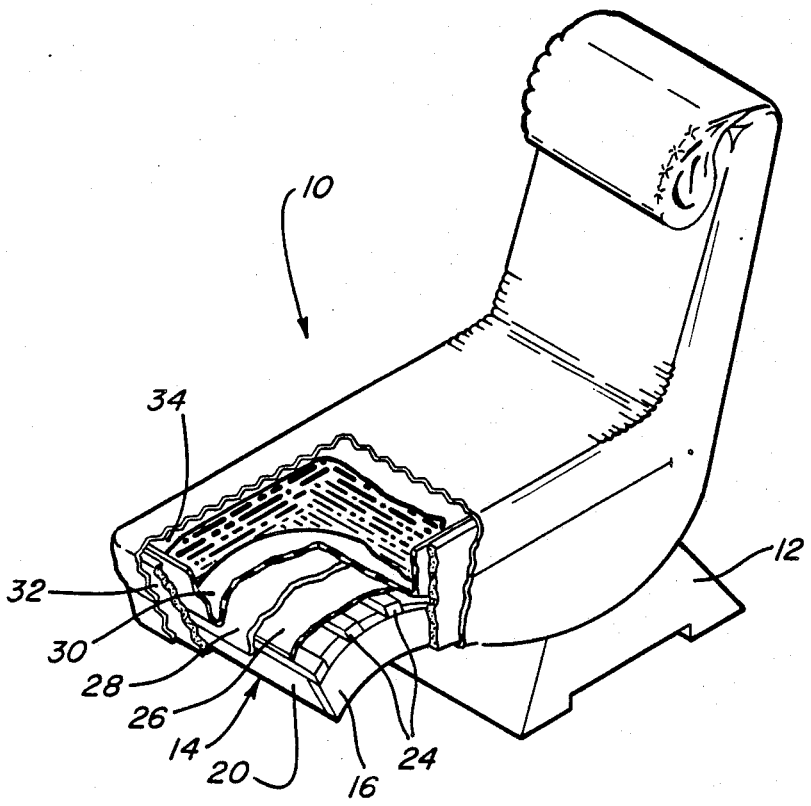
FIG. 2 is a perspective view of the water type seat structure of the present invention with portions broken away to better illustrate the internal structure of the same.

With further reference to the drawings, the water type seat structure of the present invention is shown therein and indicated generally by the numeral 10. Seat structure 10 comprises a base or pedestal 12 that is constructed of wood or some other suitable material.

Secured to base 12 is a contoured wood framed structure indicated generally by the numeral 14. Contoured wood framed structure 14 is generally "S" shaped and includes a pair of laterally spaced side members 16 that are joined about their respective ends by a lower end member 20 and an upper end member 22.

Extending between side members 16 are a series of spaced apart cross members 24. It is thusly seen that side members 16 along with end members 20 and 22 and cross member 24 form a contoured wood frame structure.

Secured to the upper surface of cross members 24 is a cardboard layer 26. Secured atop cardboard layer 26 is a vinyl cover 28. Disposed above vinyl cover 28 is a liner 30 which is impervious.

As seen in the drawings, there is formed around the contoured wood frame structure 14 a foam boxing 32. It is noted that the foam boxing 32 is actually secured to side members 16 of the frame structure and extend upwardly past the upper surface thereof so as to form an open area that is bounded by the foam boxing 32.

Disposed within the boundaries within the foam boxing 32 and situated atop liner 30 is a water bladder 34. Water bladder 34 includes an inlet/outlet opening 36.

Disposed over the entire seat structure 10 is an outer cover 38 that can be of various types of selected upholstery material.

Viewing the formed water seat structure it is seen that the same includes three basic areas, a leg support area indicated generally by the numeral 40, a well cavity area indicated generally by the numeral 42 and a vertical or inclined back area indicated generally by the numeral 44.

Figure 4:
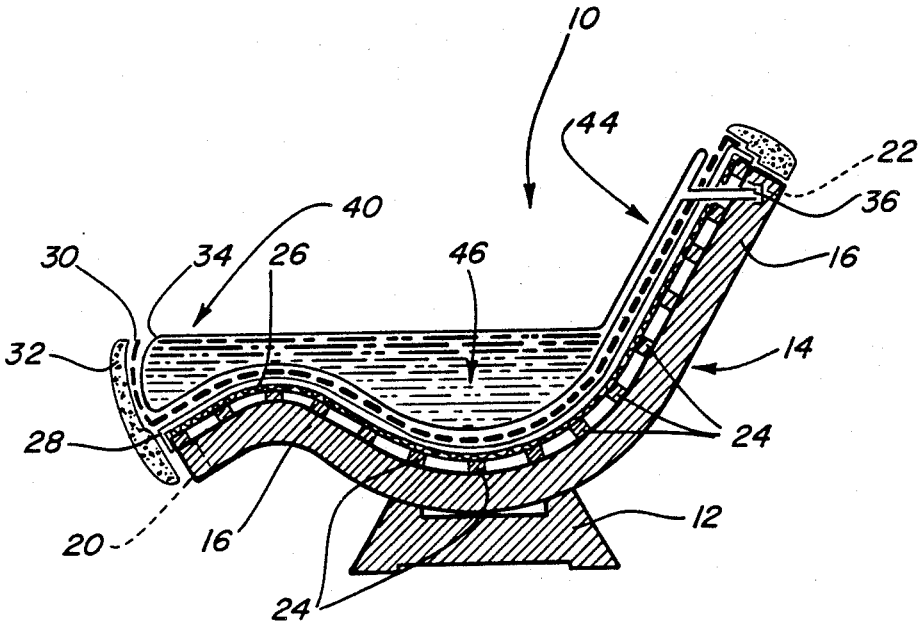
FIG. 4 is side sectional view illustrating the water type seat structure in a no-load condition.

As seen in FIG. 4, seat structure 10 assumes a no-load condition or a no-load mode. Note the formation of water well 46 formed intermediately between the back 44 and leg support area 40. It is appreciated that the water level in water well 46 is relatively deep and that the depth of the water bladder 34 becomes relatively shallow in the transition area between water well 46 and leg support area 40. Also, in the no-load condition as seen in FIG. 4, it is seen that the water bladder 34 disposed adjacent the back area 44 is empty.

Figure 3:
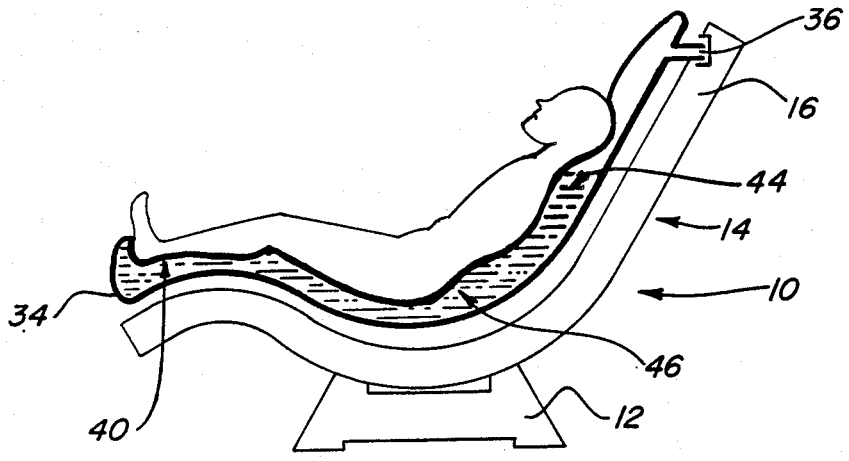
FIG. 3 is a schematic illustration of the water type seat structure of the present invention in a loaded condition.

The seat structure and particularly well cavity 42 is formed such that the water in water well 46 will be displaced upwardly through portions of the water bladder 34 disposed adjacent back 44 in response to a person actually sitting on the seat structure and particularly sitting on the area referred to as water well 46. It is appreciated that as water within water well 46 is displaced by the person occupying the seat structure 10 that the displaced water is urged up through the water bladder 34 adjacent the back area 44 of the seat structure. See FIG. 3.

It is appreciated that the seat structure of the present invention, with the water bladder 34, could assume various forms. Although the present disclosure basically shows a contoured lounge design, it is appreciated that the present invention could be embodied within a recliner or other type of seating structure. In the case of a recliner, the back area would be movable with respect to the leg support area and even a portion of the area underlying the water well 46. But in any event, the portion of the water bladder 34 extending upwardly adjacent the back area 44 would assume an empty state during a no-load condition. Just as described above, once the water well area 46 of the seating structure is loaded, there would be a displacement of water from the water well and the displaced water would be urged up the recliner's back area.

From the foregoing specification and discussion, it is appreciated that the present invention forms a relatively simple but practical water type seat structure. Even with the water bladder 34 filled, the present seat structure can be hand-carried by two adults. It is therefore a lightweight and stable seat structure.

The present invention, may of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A water containing seat structure having a displacable well portion comprising:

(a) a base;

(b) a contoured frame structure supported by the base and including a leg support area, a well cavity, and an inclined back;

(c) a water containing bladder supported on the contoured frame structure and including a water well lying between the back and the leg area and wherein in a no-load mode the upper most level of the water well terminates about a lower portion of the back;

(d) the water bladder further including a leg support portion that extends from the water well over the leg support area;

(e) the water bladder further including in a no-load mode an empty back portion that is communicatively open to the water well and extends up the inclined back of the contoured frame; and (f) wherein the water well forms a relatively deep water pocket in the no-load mode and is particularly disposed with respect to the empty back portion of the water bladder such that by placing a load on the water well results in the water within the water well being displaced therefrom and upwardly into the back portion of the water bladder where the displaced water generally conforms to the shape of the back area of a person imposing the load on the water well.

2. The water containing seat structure of claim 1 wherein the water bladder stretches from the leg support area to an upper terminal end of the inclined back and wherein the water bladder includes an inlet-outlet opening formed at the upper terminal end of the inclined back.

3. The water containing seat structure of claim 1 wherein the seat structure includes an outer cover that encloses the water bladder and the contoured frame structure and wherein the outer cover includes gathered seam means that extend adjacent the formed water well such that the outer cover can easily expand and contract in that area.

4. The water containing seat structure of claim 1 wherein the depth of the water bladder in a no-load condition varies from the terminal end of the leg support area to the terminal end of the inclined back, the variation in depth in the no-load condition being evidenced by the water well being the deepest, the area overlying the leg support area being the next deepest, the area of transition between the water well and leg support area being the next deepest, and finally the upper portion of the inclined back being empty and consequently having no water depth.

5. A method of holding water in a seat structure displacing the water about a subject that occupies the seat structure, comprising:

(a) forming a contoured seat structure;

(b) forming a relatively deep water well between an inclined back and a leg support area of the seat structure;

(c) in a no-load mode, confining the water well such that its upper level terminates about a lower portion of the back such that the back effectively forms a dam for the water well;

(d) forming in a no-load mode a water layer that varies in depth from the leg support area to an intermediate area on the seating structure and forming a continuous layer of water from the water well to and across the leg support area with the depth of the water in the leg support being substantially less than the depth of the water in the water well; and (e) displacing water from the water well and urging water from the water well up the inclined back portion of the seat structure in response to a person sitting on the water well, whereby the displaced water from the water well moves around the back of the subject occupying the seat and stabilizes around the back area of that person while he or she occupies the seat structure.

6. The method of claim 5 including forming in a no-load mode a water layer that varies in depth from a leg support area to an intermediate area on a seating structure, including forming a relatively deep water well between the leg support area and the inclined back and forming a continuous layer of water from the water well to and across the leg support area with the depth of the water in the leg support being substantially less than the depth of the water in the water well.

* * * * *